US010328713B2

(12) United States Patent
Kondo

(10) Patent No.: US 10,328,713 B2
(45) Date of Patent: Jun. 25, 2019

(54) IMAGE PROCESSING APPARATUS DETERMINING FINALIZED BAND DATA WHICH IS CAPABLE OF BEING PRINTED BY ONE SCANNING OF PRINT HEAD

(71) Applicant: BROTHER KOGYO KABUSHIKI KAISHA, Nagoya, Aichi (JP)

(72) Inventor: Tomoya Kondo, Konan (JP)

(73) Assignee: Brother Kogyo Kabushiki Kaisha, Nagoya, Aichi (JP)

( * ) Notice: Subject to any disclaimer, the term of this patent is extended or adjusted under 35 U.S.C. 154(b) by 0 days.

(21) Appl. No.: 15/891,874

(22) Filed: Feb. 8, 2018

(65) Prior Publication Data

US 2018/0229509 A1 Aug. 16, 2018

(30) Foreign Application Priority Data

Feb. 10, 2017 (JP) ..... 2017-023301

(51) Int. Cl.
*B41J 2/21* (2006.01)
*B41J 5/30* (2006.01)

(52) U.S. Cl.
CPC .. *B41J 2/21* (2013.01); *B41J 5/30* (2013.01)

(58) Field of Classification Search
CPC ..... B41J 2/2132; B41J 2/2135; B41J 2/21
See application file for complete search history.

(56) References Cited

U.S. PATENT DOCUMENTS

2006/0071955 A1* 4/2006 Arazaki ..... B41J 2/17546 347/5
2009/0251499 A1* 10/2009 Santo ..... G06K 15/105 347/9
2013/0265357 A1* 10/2013 Takeda ..... B41J 2/04535 347/15

FOREIGN PATENT DOCUMENTS

JP 2006-168052 A 6/2006
JP 2013-163294 A 8/2013

* cited by examiner

*Primary Examiner* — Jason S Uhlenhake
(74) *Attorney, Agent, or Firm* — Scully, Scott, Murphy & Presser, PC

(57) ABSTRACT

An image processing apparatus extracts provisional band data from image data. The apparatus calculates near white number for a target line. The near white number is number of pairs of first and second pixels. The first pixel is located on the target line, the second pixel is in positionally adjacent relation to the first pixel. At least one of the first pixel and the second pixel is a near white pixel. In a case where a prescribed border condition is met for the target line, the apparatus determines finalized band data so that a finalized band image includes at least part of the provisional band image, and has the target line as a borderline. In a case where a specific condition is met, the apparatus changes the target line to one of a plurality of candidate lines which is not selected as the target line.

20 Claims, 5 Drawing Sheets

IMAGE PROCESSING APPARATUS DETERMINING FINALIZED BAND DATA WHICH IS CAPABLE OF BEING PRINTED BY ONE SCANNING OF PRINT HEAD

CROSS REFERENCE TO RELATED APPLICATION

This application claims priority from Japanese Patent Application No. 2017-023301 filed Feb. 10, 2017. The entire content of the priority application is incorporated herein by reference.

TECHNICAL FIELD

The present disclosure relates an image processing program and an image processing apparatus.

BACKGROUND

An inkjet printing apparatus known in the art prints images on a printing medium, such as paper, by ejecting ink droplets onto the printing medium from nozzle rows formed in a print head while scanning the print head in a direction orthogonal to the nozzle rows.

This type of printing apparatus prints images in units of bands. Each band is formed in a different scan of the print head. Sometimes a light or dark streak, a problem known as banding, is produced at the border of two neighboring bands.

To resolve this issue, a technology was proposed to modify the widths of the bands when it is determined that an object (text or an image) overlaps a border between bands. The widths of the bands are modified so that the object does not overlap a border.

SUMMARY

However, the conventional technology described above cannot modify the widths of image bands to prevent an object with a large surface area from overlapping a border between bands and must simply print the objects across the border.

In view of the foregoing, it is an object of the present disclosure to suppress a decline in printing quality, even when it is necessary to print an object across borders between image bands.

In order to attain the above and other objects, the disclosure provides a non-transitory computer readable storage medium storing a set of program instructions installed on and executed by a computer as an image processor for controlling a print execution machine having a print head configured to eject ink from a plurality of nozzles arranged in a subscanning direction and a conveyance machine configured to convey a recording sheet, wherein the print execution machine is configured to print an image on the recording sheet by scanning the print head a plurality of times in a main scanning direction perpendicular to the subscanning direction. The set of program instructions includes: extracting, from image data representing an original image, provisional band data representing a provisional band image, the provisional band image being capable of being printed by one scanning of the print head, the provisional band image including a plurality of candidate lines, each of the plurality of candidate lines having a plurality of pixels arranged in the main scanning direction; identifying a target line from the plurality of candidate lines and a neighboring line neighboring the target line in the original image; calculating near white number for the target line, the near white number for the target line being number of pairs of a first pixel and a second pixel, wherein the first pixel is located on the target line, the second pixel is located on the neighboring line and in positionally adjacent relation to the first pixel, and at least one of the first pixel and the second pixel is a near white pixel, wherein the near white pixel is defined as a pixel satisfying at least one of a condition that a chroma value of the pixel is smaller than or equal to a chroma threshold value and a condition that a lightness value of the pixel is greater than or equal to a lightness threshold value; determining whether a prescribed boarder condition for the target line is met, wherein the prescribed border condition for the target line indicates that the near white number for the target line is greater than or equal to a first threshold value; in a case where the prescribed border condition is met for the target line, determining finalized band data representing a finalized band image, the finalized band image including at least part of the provisional band image, the finalized band image having the target line as a borderline, the border line being closest to a border of the finalized band image, the finalized band image being capable of being printed by one scanning of the print head; outputting image data including band data based on the finalized band data to the print execution machine; and in a case where a specific condition is met, changing the target line to one of the plurality of candidate lines which is not selected as the target line, the specific condition including a condition that the prescribed border condition is not met for the current target line.

According to another aspects, the disclosure provides an image processing apparatus. The image processing apparatus includes a print execution machine, a processor, and a memory. The print execution machine has a print head configured to eject ink from a plurality of nozzles arranged in a subscanning direction and a conveyance machine configured to convey a recording sheet. The print execution machine is configured to print an image on the recording sheet by scanning the print head a plurality of times in a main scanning direction perpendicular to the subscanning direction. The processor includes hardware. The memory stores computer-readable instructions therein. The computer-readable instructions, when executed by the processor, causes the image processing apparatus to perform: extracting, from image data representing an original image, provisional band data representing a provisional band image, the provisional band image being capable of being printed by one scanning of the print head, the provisional band image including a plurality of candidate lines, each of the plurality of candidate lines having a plurality of pixels arranged in the main scanning direction; identifying a target line from the plurality of candidate lines and a neighboring line neighboring the target line in the original image; calculating near white number for the target line, the near white number for the target line being number of pairs of a first pixel and a second pixel, wherein the first pixel is located on the target line, the second pixel is located on the neighboring line and in positionally adjacent relation to the first pixel, and at least one of the first pixel and the second pixel is a near white pixel, wherein the near white pixel is defined as a pixel satisfying at least one of a condition that a chroma value of the pixel is smaller than or equal to a chroma threshold value and a condition that a lightness value of the pixel is greater than or equal to a lightness threshold value; determining whether a prescribed boarder condition for the target line is met, wherein the prescribed border condition for the target line indicates that the near white number for the target line is greater than or equal to a first threshold value; in a case where the prescribed border condition is met for the target line, determining finalized band data representing a finalized band image, the finalized band image including at least part of the provisional band image, the finalized band image having the target line as a borderline, the border line being closest to a border of the finalized band image, the finalized band image being capable of being printed by one scanning of the print head; outputting image data including band data based on the finalized band data to the print execution machine; and in a case where a specific condition is met, changing the target line to one of the plurality of candidate lines which is not selected as the target line, the specific condition including a condition that the prescribed border condition is not met for the current target line.

According to still another aspects, the disclosure provides a method for controlling a print execution machine having a print head configured to eject ink from a plurality of nozzles arranged in a subscanning direction and a conveyance machine configured to convey a recording sheet, wherein the print execution machine is configured to print an image on the recording sheet by scanning the print head a plurality of times in a main scanning direction perpendicular to the subscanning direction. The method includes: extracting, from image data representing an original image, provisional band data representing a provisional band image, the provisional band image being capable of being printed by one scanning of the print head, the provisional band image including a plurality of candidate lines, each of the plurality of candidate lines having a plurality of pixels arranged in the main scanning direction; identifying a target line from the plurality of candidate lines and a neighboring line neighboring the target line in the original image; calculating near white number for the target line, the near white number for the target line being number of pairs of a first pixel and a second pixel, wherein the first pixel is located on the target line, the second pixel is located on the neighboring line and in positionally adjacent relation to the first pixel, and at least one of the first pixel and the second pixel is a near white pixel, wherein the near white pixel is defined as a pixel satisfying at least one of a condition that a chroma value of the pixel is smaller than or equal to a chroma threshold value and a condition that a lightness value of the pixel is greater than or equal to a lightness threshold value; determining whether a prescribed boarder condition for the target line is met, wherein the prescribed border condition for the target line indicates that the near white number for the target line is greater than or equal to a first threshold value; in a case where the prescribed border condition is met for the target line, determining finalized band data representing a finalized band image, the finalized band image including at least part of the provisional band image, the finalized band image having the target line as a borderline, the border line being closest to a border of the finalized band image, the finalized band image being capable of being printed by one scanning of the print head; outputting image data including band data based on the finalized band data to the print execution machine; and in a case where a specific condition is met, changing the target line to one of the plurality of candidate lines which is not selected as the target line, the specific condition including a condition that the prescribed border condition is not met for the current target line.

BRIEF DESCRIPTION OF THE DRAWINGS

The particular features and advantages of the disclosure as well as other objects will become apparent from the following description taken in connection with the accompanying drawings, in which.

DETAILED DESCRIPTION

Next, embodiments of the present disclosure will be described while referring to the accompanying drawings.

1. First Embodiment

1-1. Structure of a Printing System

Figure 1:
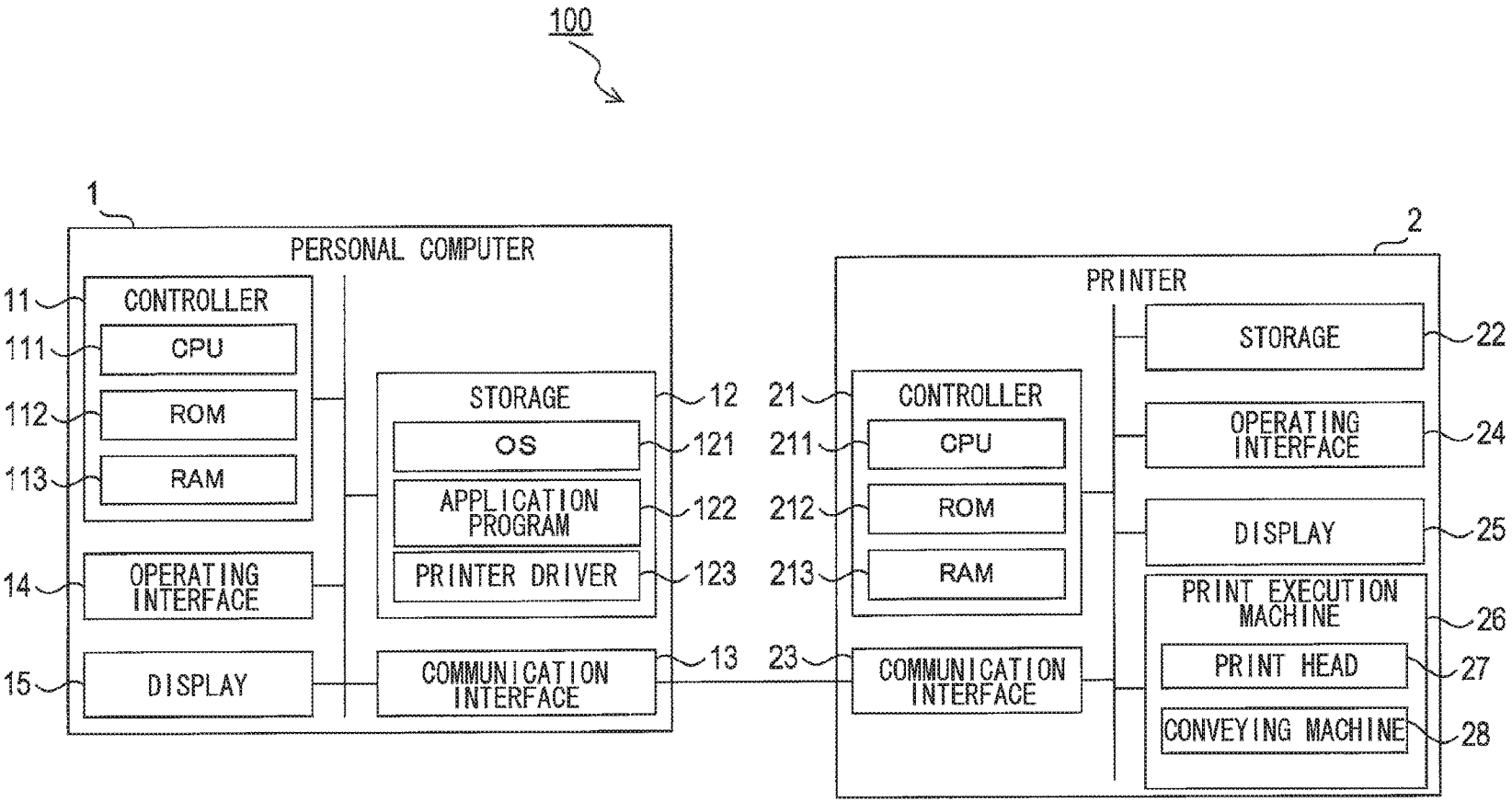
FIG. 1 is a block diagram illustrating a printing system according to a first embodiment.

A printing system 100 shown in FIG. 1 includes a personal computer 1 and a printer 2 that are capable of communicating with each other by transmitting and receiving data. The personal computer 1 is a general-purpose image processing apparatus that includes a controller 11, a storage 12, a communication interface 13, an operating interface 14, and a display 15.

The controller 11 performs overall control of all components in the personal computer 1. The controller 11 includes a CPU 111, a ROM 112, and a RAM 113.

The storage 12 is a rewritable nonvolatile storage. In the embodiment, a hard disk drive is used as the storage 12. The storage 12 stores an operating system (OS) 121, an application program 122 such as a graphics tool, and a printer driver 123. The printer driver 123 is a program that enables the personal computer 1 to use the printer 2.

The communication interface 13 is an interface for facilitating data communications with the printer 2.

The operating interface 14 is an input device that allows the user to input commands through external operations. In the embodiment, a keyboard and a pointing device, such as a mouse or touchpad, are used as the operating interface 14.

The display 15 is an output device for displaying various information as visually discernable images to the user. In the embodiment, a liquid crystal display is used as the display 15.

The printer 2 is an inkjet-type printing apparatus. The printer 2 includes a controller 21, a storage 22, a communication interface 23, an operating interface 24, a display 25, and a print execution machine 26.

The controller 21 performs overall control of the components of the printer 2. The controller 21 includes a CPU 211, a ROM 212, and a RAM 213.

The storage 22 is a rewritable nonvolatile storage. In the embodiment, flash memory is used as the storage 22.

The communication interface 23 is an interface that facilitates data communications with the personal computer 1.

The operating interface 24 is an input device that enables the user to input commands through external operations. The operating interface 24 includes various operating buttons.

The display 25 is an output device for displaying various information as visually discernable images to the user. A small liquid crystal display is used as the display 25 in the embodiment.

The print execution machine 26 includes a print head 27, and a conveying machine 28.

The print head 27 is movable in a direction (main scanning direction) orthogonal to the paper-conveying direction (sub scanning direction). Nozzles for ejecting ink droplets in each of the colors cyan (C), magenta (M), yellow (Y), and black (K) are formed in the surface of the print head 27 that opposes the printing medium (e.g., paper). The nozzles are arranged in rows. Each row extends in the sub scanning direction. A total of four nozzle rows are arranged in the main scanning direction and correspond to respective colors of CMYK. The print execution machine 26 prints band-like partial images on the paper by scanning the print head 27 while ejecting ink droplets from the print head 27 onto the paper on the basis of image data. The band-like partial images constitute the overall target image being printed and will be called "band images" hereafter. Each band image includes a plurality of lines, and each line is configured of a plurality of pixels aligned in the main scanning direction. In the embodiment, a band image having a maximum width of 300 lines can be printed in one scan of the print head 27. The width of the band image can be adjusted by limiting the number of nozzles that eject ink droplets in a scan. Further, the print execution machine 26 can eject ink droplets from the nozzles of the print head 27 in a plurality of different sizes, thereby printing in a plurality of gradation levels (four levels, for example). In the embodiment, the printer 2 performs printing according to a single-pass method in which a plurality of consecutive lines is printed simultaneously in one scan of the print head 27.

The conveying machine 28 conveys sheets of paper. By alternately printing a band image with the print head 27 and conveying the sheet with the conveying machine 28 a plurality of times, the printer 2 prints one page worth of an image on the sheet.

2. Processes

2-1. Printing Process

Next, a printing process executed by the personal computer 1 will be described with reference to FIG. 2. When a starting operation for printing a target image is made by the user through the running application program 122, the printer driver 123 on the personal computer 1 is started. The controller 11 of the personal computer 1 executes the process in S101-S106 described below in conformance with the printer driver 123. This process is an image process for controlling the printer 2 to print the target image.

Figure 2:
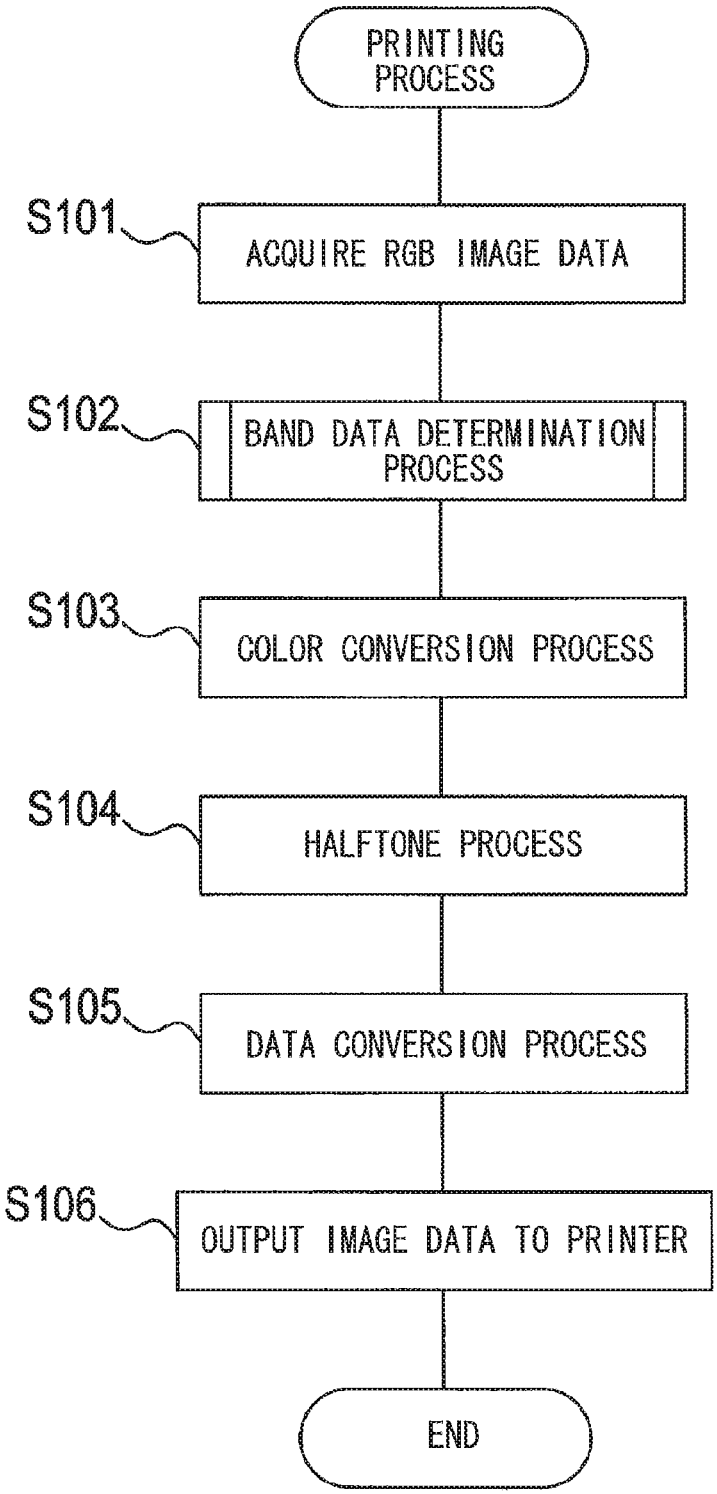
FIG. 2 is a flowchart illustrating a printing process according to the first embodiment.

In S101 of FIG. 2, the controller 11 acquires image data from the application program 122. The image data represents the target image in RGB values of 256 gradations (from 0 to 255; otherwise known as an 8-bit range). If the target image spans a plurality of pages, the controller 11 acquires a plurality of pages worth of image data at this time.

In S102 the controller 11 executes a band data determination process on each set of image data representing an image on each page for determining band image representing band images that constitute an image on each page. The band data determination process will be described later in greater detail.

In S103 the controller 11 performs a color conversion process on the image data for which a plurality of sets of band data (specifically, finalized band data) has been determined. By executing this color conversion process, the controller 11 converts the image data represented by 256-level RGB values to image data represented by 256-level CMYK values corresponding to the CMYK ink colors, which the printer 2 uses for printing. This color conversion process is performed on the basis of a lookup table that is pre-stored on the personal computer 1. The lookup table specifies correlations between RGB values and CMYK values.

In S104 the controller 11 performs a halftone process to convert the image data expressed in 256-level CMYK values to image data expressed in CMYK values of the number of levels that can be rendered by the printer 2 (four levels in this example).

In S105 the controller 11 executes a data conversion process to add control commands for controlling the printer 2 to the image data produced in the halftone process. The control commands added in this step include information related to the type and size of the paper on which the image will be printed, for example. The image data generated in S105 includes a plurality of sets of band data which is based on the plurality of sets of finalized band data determined in S102. That is, the image data generated in S105 includes the plurality of sets of band data respectively representing the plurality of sets of band image which is determined in S102. In other words, each of the plurality of sets of band data included in the image data generated in S105 is generated by executing the processes S103-S105 on the finalized band data determined in S102.

In S106 the controller 11 outputs the image data produced in the data conversion process to the printer 2. Accordingly, the print execution machine 26 of the printer 2 prints the image represented by this image data on paper.

2-2. Band Data Determination Process

Next, the band data determination process executed in S102 of the printing process will be described with reference to the flowchart in FIG. 3. The band data determination process is performed on image data as a process target on a page-to-page basis.

In S201 the controller 11 first acquires provisional band data representing a provisional band image in the target image data. This provisional band data represents a band image having a prescribed width. In the embodiment, the width of the provisional band image signifies the length of the band image in the sub scanning direction and is shorter than the length of the print head 27 in the sub scanning direction. Specifically, the width of the provisional band image is set to the maximum width that the print head 27 can print in one scan. In the embodiment, the width is set to a width equivalent to 300 lines. As will be described later, step S201 is executed a plurality of times. Each time the process of S201 is executed, the controller 11 sequentially acquires each set of provisional band data in a predetermined order, and specifically in an order beginning from provisional band data representing a provisional band image positioned on one end of the image represented by the target image data. In the embodiment, the target image data is stored in the storage 12, and the controller 11 acquires a portion of this target image data from the storage 12 as the provisional band data.

In S202 the controller 11 identifies a target line and a neighboring line. The target line in this example is one of the plurality of lines constituting the provisional band image. In the embodiment, the target line is identified as a borderline in the provisional band image. A borderline is a line in the provisional band data positioned nearest a side (border) in the sub scanning direction. Thus, each provisional band image has two borderlines. The target line is identified as the borderline neighboring the next provisional band image to be acquired. The neighboring line is a line in the image represented by the target image data that neighbors the target line. When the target line is positioned adjacent to the border of the provisional band image in the sub scanning direction (i.e., when the target line is the borderline initially identified in S202), the neighboring line is positioned outside the same provisional band image. In other words, the neighboring line is the line in the next provisional band image neighboring the current provisional band image that is nearest the side in the sub scanning direction bordering the current provisional band image. Hence, the neighboring line is positioned adjacent to the target line in the sub scanning direction on the opposite side of the border between the two band images.

In S203 the controller 11 calculates a white count M1 for the target line and the neighboring line by referencing the pixel values for all pixels included in the target line or the neighboring line. The white count M1 in this example denotes the number of pairs of first and second pixels having at least one white pixel, where the first pixel is any pixel in the target line and the second pixel is a pixel that is in the neighboring line and neighbors the first pixel. Here, a white pixel is a pixel whose RGB values are all set to the maximum values. The maximum RGB value is 255 in the embodiment.

In S204 the controller 11 determines whether the white count M1 calculated in S203 is greater than or equal to a threshold value Th1. The controller 11 advances to S205 when determining in S204 that the white count M1 is greater than or equal to the threshold value Th1 (S204: YES).

In S205 the controller 11 determines band data representing a band image having the current target line as the borderline. Through this step, the controller 11 determines finalized band data in place of the provisional band data. This finalized band data represents a finalized band image that constitutes at least part of the provisional band image in which the target line serves as the borderline. In other words, when the controller 11 determines in S204 that the white count M1 is greater than or equal to a prescribed value, i.e., when the target line is at a position in which banding is likely to be inconspicuous, the controller 11 determines finalized band data representing a single finalized band image having the target line as its borderline. Here, another borderline of the finalized band image (a border line opposite to the target line) matches another borderline of the provisional band image.

On the other hand, if the controller 11 determines in S204 that the white count M1 is less than the threshold value Th1 (S204: NO), the controller 11 advances to S206. In S206 the controller 11 calculates a near-white count M2 for the target line and the neighboring line by referencing the pixel values of all pixels included in the target line or the neighboring line. In this example, the near-white count M2 is the number of pairs of first and second pixels having at least one near-white pixel, where the first pixel is any pixel in the target line and the second pixel is a pixel that is in the neighboring line and neighbors the first pixel. Near-white pixels are predefined to include white pixels and pixels having a chroma and lightness that are not white but approach white. A near-white pixel satisfies at least one of a condition that the chroma is no greater than a prescribed chroma threshold value and a condition that the lightness is at least a prescribed lightness threshold value. In the embodiment, near-white pixels are defined as pixels having an inverted lightness value and a chroma value whose sum is no greater than a threshold value Th4. Here, the inverted lightness value is obtained by reversing the plus/minus sign of the lightness value. In other words, if the lightness is L, the inverse of lightness is −L. In the following description, the near-white count M2 of a target line and a neighboring line will simply be called the near-white count M2 of the target line.

In S207 the controller 11 determines whether the near-white count M2 calculated in S206 is greater than or equal to a threshold value Th2.

The controller 11 advances to S205 described above when determining in S207 that the near-white count M2 is greater than or equal to the threshold value Th2 (S207: YES). Hence, when determining that the near-white count M2 is greater than or equal to the threshold value Th2, in S205 the controller 11 determines finalized band data specifying a finalized band image in which the target line is a borderline, even after determining in S204 that the white count M1 is less than the threshold value Th1. Thus, satisfying at least one of the conditions that the white count M1 is greater than or equal to the threshold value Th1 and that the near-white count M2 is greater than or equal to the threshold value Th2 is sufficient for setting the target line as a borderline in the embodiment. In other words, the controller 11 determines that a prescribed border condition for the target line being the borderline is satisfied when either determining that the white count M1 is greater than or equal to the threshold value Th1 or determining that the near-white count M2 is greater than or equal to the threshold value Th2.

Conversely, the controller 11 determines that the border condition is not satisfied when determining both that the white count M1 is less than the threshold value Th1 and that the near-white count M2 is less than the threshold value Th2. In other words, the controller 11 determines that the border condition is not satisfied at least when determining that the near-white count M2 is less than the threshold value Th2.

The controller 11 advances to S208 when determining in S207 that the near-white count M2 is less than the threshold value Th2 (S207: NO), i.e., when determining that both the white count M1 and near-white count M2 are less than their threshold values.

In S208 the controller 11 determines whether all of a prescribed plurality of lines (hereinafter called "candidate lines") in the provisional band image have been selected to be the target line. In the embodiment, the candidate lines are set as a prescribed number of lines (150 lines) among the 300 lines constituting the provisional band image that are positioned on the side nearest the next provisional band image that neighbors the current provisional band image. As will be described later, if the controller 11 determines in S204 and S207 that the border condition is not satisfied for the current target line, the determinations in S204 and S207 are repeated with a new target line. However, these determinations are performed for only some of the lines in the provisional band image rather than all of the lines. A candidate line is a line on which these determinations are performed, i.e., a line that may be determined as the borderline in the finalized band image. Note that the process of S208 may be executed a plurality of times, as will be described later. Since only one of the candidate lines has been selected to be the target line when the process of S208 is first executed, the controller 11 determines that not all candidate lines have been selected as the target line.

When the controller 11 determines in S208 that not all candidate lines have been selected to be the target line, i.e. that there remain lines that have not yet been processed as the target line (S208: NO), in S209 the controller 11 changes the target line to a line which is one line inward of the current target line and located in the provisional band image. That is, the controller 11 changes the target line to the line in the provisional band image adjacent to the current target line (i.e., the target line prior to this change) on the side away from the borderline. In this way, the controller 11 of the embodiment first identifies the target line as a borderline in the provisional band image. Next, if the controller 11 determines that the border condition is not met, the controller 11 changes the target line in a predetermined sequence, i.e., one by one in sequence toward the inside of the provisional band image.

After completing S209, the controller 11 returns to S202. Hence, as long as the controller 11 determines that not all candidate lines have been selected to be the target line, the controller 11 continually changes the target line and repeats the determinations in S204 and S207 based on the white count M1 and the near-white count M2 described above until discovering a target line that is suitable to be the borderline. After executing S209, in S202 the controller 11 identifies the target line with the target line changed in S209 and identifies the neighboring line with a line that is adjacent to the target line and is closer to the borderline than the target line is to the borderline.

On the other hand, if the controller 11 determines in S208 that all candidate lines have been selected as the target line (S208: YES), the controller 11 advances to S210 and sets the target line to the line having the largest near-white count M2 among all lines that were selected as the target line. If there are a plurality of lines having the largest near-white count M2, the controller 11 sets the target line to the line among the plurality of lines having the largest near-white count M2 that is positioned nearest the border in the sub scanning direction. After completing the process in S210 the controller 11 advances to S205 described above. In other words, when none of the candidate lines satisfies the border condition, the controller 11 sets finalized band data representing a finalized band image in which the line having the largest near-white count M2 is the borderline.

The controller 11 advances to S211 after executing step S205 described above. In S211 the controller 11 determines whether all sets of finalized band data constituting the target image data has been determined. Here, the controller 11 determines that all sets of finalized band data has been determined when the number of lines that have not been set as a finalized band image is less than or equal to the number of lines that can be printed in a single scan of the print head 27, i.e., less than or equal to 300 lines in the embodiment. On the other hand, if the number of lines that have not been set is greater than 300 lines, the controller 11 determines that not all finalized band data has been determined, i.e., that there remains finalized band data to be determined. Note that if the number of undetermined lines is less than or equal to 300 lines, the controller 11 determines finalized band data that represents a single finalized band image including all remaining lines. Thus, all finalized band images are images having a width no greater than 300 lines, that is, images that can be printed in a single scan of the print head 27.

If the controller 11 determines in S211 that not all sets of finalized band data constituting the target image data has been determined (S211: NO), the controller 11 returns to S201 and repeats the process described above beginning from S201. In the second and subsequent executions of S201, the controller 11 acquires provisional band data representing the next provisional band image neighboring the finalized band image represented by the finalized band data just set in S205.

On the other hand, the controller 11 advances to S212 when determining in S211 that all finalized band data constituting the target image data has been determined (S211: YES). In S212 the controller 11 determines whether the number N of sets of finalized band data constituting the target image data is less than or equal to a threshold value Th3. In the embodiment, seven finalized band images are determined per page when all sets of finalized band data constituting the target image data are determined to the width of the provisional band image. In the embodiment, the threshold value Th3 is set to 8, that is, one more than the seven finalized band images in this example.

The controller 11 advances to S213 when determining in S212 that the number N of sets of finalized band data is greater than the threshold value Th3 (S212: NO). In S213 the controller 11 decreases each of the prescribed values of the threshold value Th1 for the white count M1 and the threshold value Th2 for the near-white count M2 by respective prescribed values so as to set a modified prescribed threshold value Th1 and a modified prescribed threshold value Th2 which will be used in subsequently executed S204 and S207 respectively. Note that the values of the threshold values Th1 and Th2 may be decreased by the same prescribed value or by different prescribed values.

In S214 the controller 11 cancels the determinations for all of the sets of the finalized band data and returns to S201. That is, finalized band data is determined again for the target image data by using the threshold values Th1 and Th2 which is modified in S213.

On the other hand, if the controller 11 determines in S212 that the number N of sets of finalized band data is less than or equal to the threshold value Th3 (S212: YES), the controller 11 ends the band data determination process.

2-3. Illustrative Example

Next, an example of setting the borders of finalized band images when executing the above band data determination process according to the embodiment will be described with reference to FIG. 4.

Figure 4:
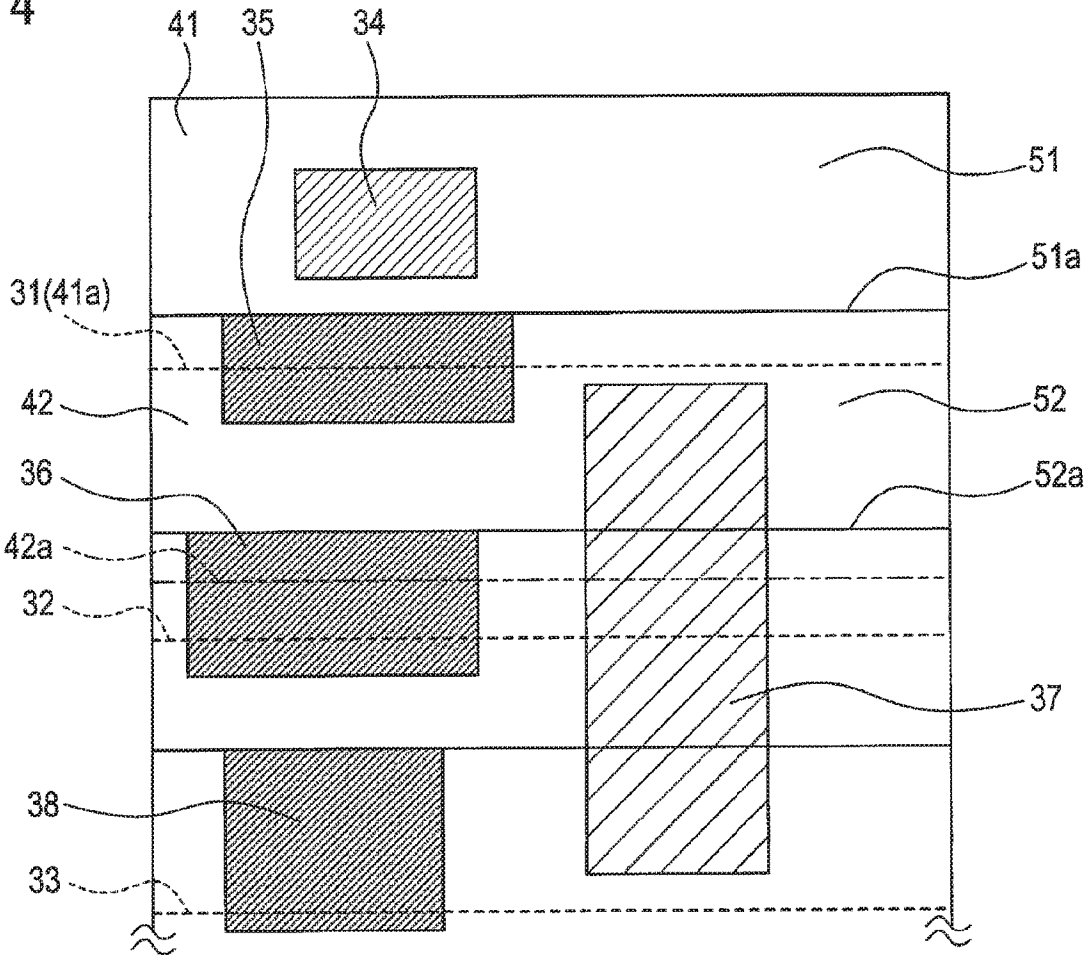
FIG. 4 is an explanatory diagram illustrating borders of provisional band images and borders of finalized band images.

Horizontal dashed lines 31-34 in FIG. 4 indicate the positions of the borders of finalized band images when all finalized band images constituting the image represented by the target image data have the width of the provisional band image. The following example will illustrate how the borders of finalized band images are modified relative to these border positions. The image shown in FIG. 4 has a plurality of objects 34-38. In this example, all areas of the image other than these objects 34-38 are white. The object 37 in particular has considerable length in the sub scanning direction (vertical direction in FIG. 4). This presents difficulties in setting the borders of the finalized band images to avoid the object 37.

In the first execution of S201, the controller 11 acquires provisional band data representing a first provisional band image 41 occupying the top end of the image shown in FIG. 4. In S202 the controller 11 identifies the line immediately above the lower border 41*a* of the first provisional band image 41 and the line immediately below the lower border 41*a* as the target line and the neighboring line, respectively. As shown in FIG. 4, the object 35 is present on both the target line and the neighboring line. None of the pixels in the object 35 are near-white pixels. Accordingly, after the controller 11 calculates the white count M1 of the target line and the neighboring line in S203, in S204 the controller 11 determines that the white count M1 is less than the threshold value Th1, owing to the presence of the object 35. As a result, the controller 11 calculates the near-white count M2 in S206. In S207 the controller 11 determines that the near-white count M2 is less than the threshold value Th2 owing to the presence of object 35. Accordingly, the controller 11 determines that the border condition for this target line is not satisfied. Hence, in S209 the controller 11 changes the target line to one line inward in the first provisional band image 41 (one line above the current target line in FIG. 4). After modifying the target line, the controller 11 repeats the determinations in S204, S207, and the like for the new target line and neighboring line. However, since the object 35 is still present on the new target line and neighboring line, the controller 11 again determines that the white count M1 and the near-white count M2 are less than their threshold values. Therefore, the controller 11 changes the target line again. By repeating this procedure, the controller 11 gradually moves the target line upward in FIG. 4. When the target line has been changed to the line immediately above the object 35, all pixels in the target line are now white, thereby increasing the white count M1. As a result, in S204 the controller 11 determines that the white count M1 is greater than or equal to the threshold value Th1 and in S205 sets finalized band data specifying a first finalized band image 51 having the current target line as its lower borderline. In FIG. 4, the lower border of the first finalized band image 51 is designated by the reference number 51*a*.

In S211 the controller 11 determines that not all finalized band data in the target image data has been set, and repeats the above process from S201. When S201 is executed the second time, the controller 11 acquires provisional band data representing a second provisional band image 42 that neighbors the first finalized band image 51. The upper border of the second provisional band image 42 corresponds to the lower border 51*a* of the first finalized band image 51. A lower border 42*a* of the second provisional band image 42 is positioned 300 lines below the border 51*a* of the first finalized band image 51. In this case, both the objects 36 and 37 are present on the lower border 42*a*. In S202 the controller 11 identifies the line immediately above the lower border 42*a* and the line immediately below the lower border 42*a* as the target line and the neighboring line, respectively. In this example, none of the pixels in the object 36 are near-white pixels. However, while none of the pixels in the object 37 are white pixels, all of these pixels are near-white pixels. Owing to the presence of the objects 36 and 37, the controller 11 determines that both the white count M1 and the near-white count M2 are less than their threshold values and moves the target line sequentially upward in FIG. 4. Thus, the target line is eventually moved to the line immediately above the object 36. At this point, the object 37 is still present on the target line. However, as described above, even though none of the pixels in the object 37 are white pixels, all are near-white pixels.

Therefore, in S204 the controller 11 determines that the white count M1 is less than the threshold value Th1 for this target line, but in S207 determines that the near-white count M2 is greater than or equal to the threshold value Th2. Hence, even though the object 37 is present on the target line, the controller 11 determines finalized band data representing a second finalized band image 52 having the current target line as its lower borderline. In FIG. 4, the lower border of the second finalized band image 52 is designated with the reference number 52*a*.

The controller 11 performs similar determinations for the remaining provisional band images and repeats the above process until all band images constituting the image represented by the target image data have been determined.

2-4. Effects

The following effects are obtained through the first embodiment described above.

(1) In the embodiment, the personal computer 1 determines that border condition is satisfied for a target line when the near-white count M2 of the target line is greater than or equal to the threshold value Th2. If the personal computer 1 determines that the border condition is satisfied, the personal computer 1 determines finalized band data in place of the provisional band data. This finalized band data represents a finalized band image having the current target line as its borderline. More specifically, the personal computer 1 determines finalized band data specifying a strip-like partial image having a width less than or equal to the width of the strip-like provisional band image represented by the provisional band data, wherein the borderline of the partial image is the target line that satisfies the border condition. Accordingly, the personal computer 1 sets the borderline of the finalized band image to a location in which banding is likely to be inconspicuous. Therefore, the personal computer 1 can suppress a drop in printing quality, even when it is not possible to avoid printing an object across a border between band images.

(2) In the embodiment, the personal computer 1 determines whether all candidate lines have been selected as the target line after determining that the border condition is not met for the current target line. If the personal computer 1 determines that all candidate lines have been selected to be the target line, the personal computer 1 changes the target line to a line having the largest near-white count M2 from among the candidate lines. Next, the personal computer 1 determines finalized band data in place of the provisional band data. This finalized band data represents a finalized band image whose borderline is set to the modified target line. In this way, the personal computer 1 can set the borderline of the finalized band image to a line that is least likely to have conspicuous banding, even when none of the target lines satisfy the border condition.

(3) In the embodiment, the personal computer 1 determines that the border condition is satisfied for a target line when the white count M1 of the target line is greater than or equal to the threshold value Th1. Accordingly, the personal computer 1 can find a target line that satisfies the border condition on the basis of white pixels, which is the color of pixels least likely to produce conspicuous banding. Hence, the personal computer 1 can make banding less noticeable in an image.

(4) In the embodiment, the personal computer 1 determines whether the number N of sets of finalized band data constituting the image data is less than or equal to the threshold value Th3 after determining all finalized band data in the image data. If the number N of sets of finalized band data is greater than the threshold value Th3, the personal computer 1 reduces the threshold value Th2 and cancels the determinations for all sets of finalized band data constituting the image data. Subsequently, the personal computer 1 again identifies the target line and neighboring line. In this way, the personal computer 1 can prevent the number N of sets of finalized band data from becoming too large. As a result, the personal computer 1 can suppress the number of scans that the print head 27 performs, i.e., the length of time required for printing.

(5) In the embodiment, the personal computer 1 identifies a borderline in the provisional band image as the target line. Further, the personal computer 1 identifies the neighboring line to be the line adjacent to the target line on the side of the borderline, wherein the side of the border line is opposite to the side in the provisional band image that leads away from the borderline relative to the target line. That is, the neighboring line is identified to a line that is adjacent to the target line and located on the side of the borderline relative to the target line. Next, the personal computer 1 changes the target line to the line neighboring the current target line on the side of the provisional band image farther away from the borderline relative to the target line. In other words, the personal computer 1 gives more priority to lines that are closer to the borderline in the provisional band image when selecting the target line. This enables the personal computer 1 to set the width of the band data as large as possible.

(6) In the embodiment, each near-white pixel is a pixel having an inverted lightness value and a chroma value whose sum is no greater than a threshold value Th4. This provides a simplified method of determining a color of pixels with which banding is inconspicuous.

In the embodiment, the controller 11 is an example of an image processor, S106 is an example of outputting portion, S201 is an example of an acquisition portion, S202 is an example of an identification portion, S203 is an example of a white calculation portion, S204 and S207 are examples of a border determination portion, S205 is an example of a determination portion, S206 is an example of a near white calculation portion, and S208 is an completion determination portion. S209 and S210 are examples of a modification portion, S212 is an example of a data number determination portion, S213 is an example of a second decreasing portion, and S214 is an example of a cancellation portion.

3. Second Embodiment

3-1. Differences from the First Embodiment

Fundamental structures of a second embodiment is the same as those in the first embodiment, wherein like parts and components are designated with the same reference numerals to avoid duplicating description.

The hardware structure in the second embodiment is identical to that described in the first embodiment. However, the second embodiment differs from the first embodiment by partial differences in the band data determination process executed by the controller 11 of the personal computer 1.

Figure 5:
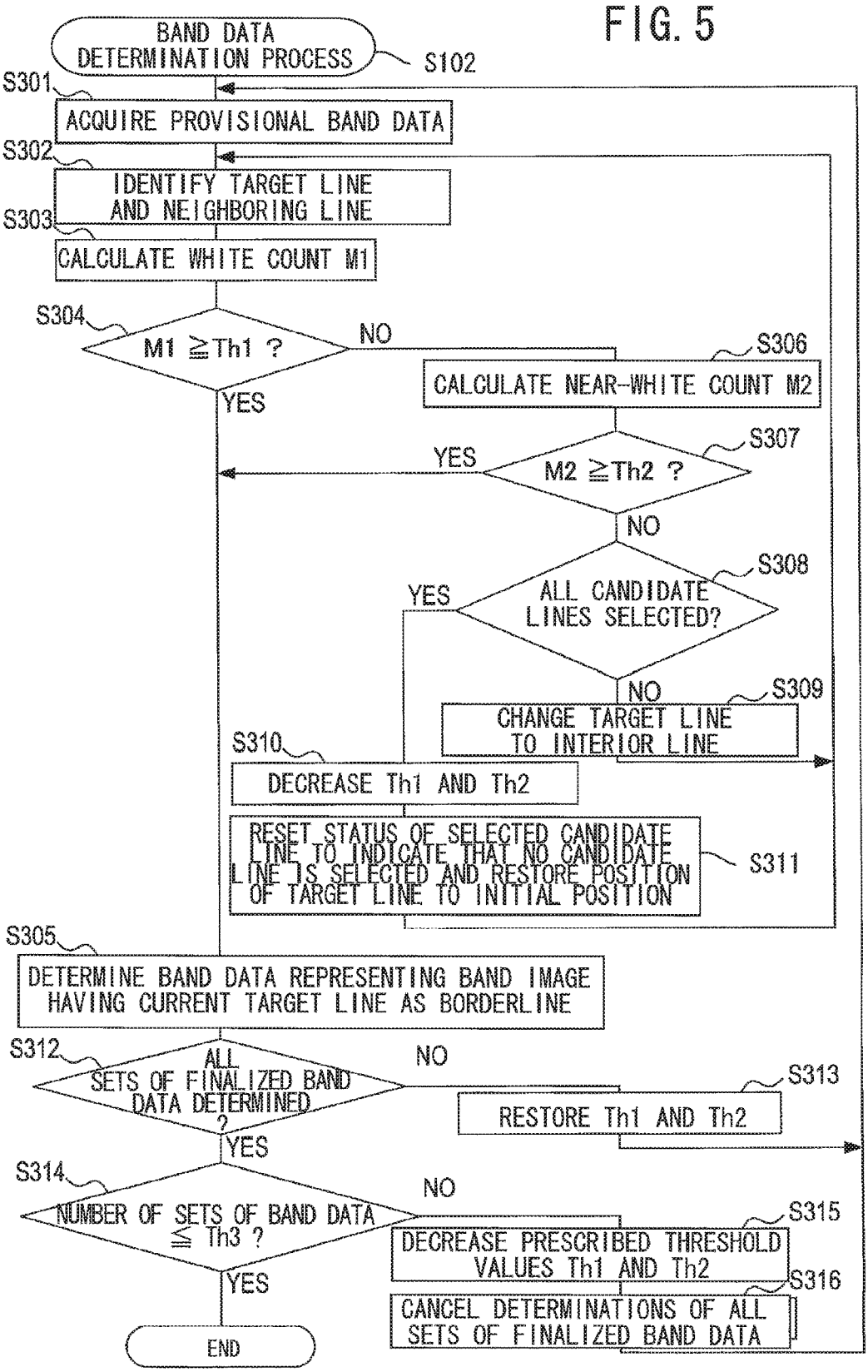
FIG. 5 is a flowchart illustrating a band data determination process according to a second embodiment.

Next, the band data determination process executed by the controller 11 in the second embodiment in place of the band data determination process of the first embodiment (see FIG. 3) will be described with reference to the flowchart in FIG. 5.

In the band data determination process according to the second embodiment shown in FIG. 5, steps S301-S309 are identical to steps S201-S209 of the first embodiment described with reference to FIG. 3, and a description of these steps will not be repeated. When the controller 11 determines in S308 that all candidate lines have been selected to be the target line, in S310 the controller 11 decreases the threshold value Th1 for the white count M1 and the threshold value Th2 for the near-white count M2 by prescribed values. Note that the threshold values Th1 and Th2 may be decreased by the same value or by different values.

In S311 the controller 11 resets the status of the selected candidate lines to indicate that no candidate lines have yet been selected as the target line, and restores the position of the target line to its initial position. Here, the initial position is the position of the borderline in the provisional band image. After completing the process of S311, the controller 11 returns to S302 described above.

Figure 3:
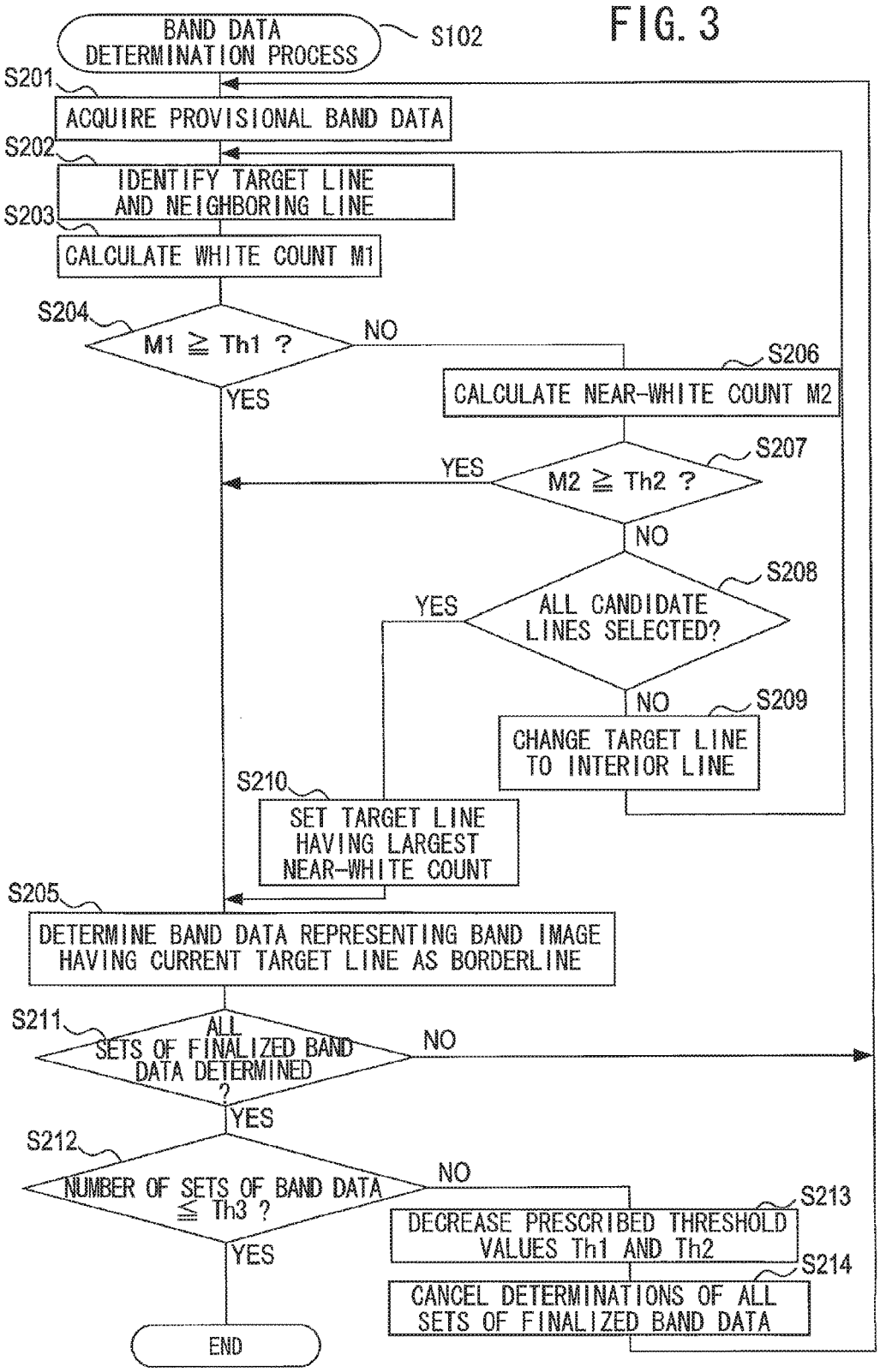
FIG. 3 is a flowchart illustrating a band data determination process according to the first embodiment.

Since step S312 is identical to step S211 of FIG. 3 described in the first embodiment, a description of this step will not be repeated. When the controller 11 determines in S312 that not all sets of finalized band data constituting the target image data have been set (S312: NO), in S313 the controller 11 restores the threshold value Th1 for the white count M1 and the threshold value Th2 for the near-white count M2 to their initial prescribed values. In this way, the values of the threshold value Th1 and threshold value Th2 that were decreased in S310 described above are returned to their original values so that the determinations in S304 and S307 for the next acquired provisional band image will be performed with the original threshold values Th1 and Th2.

Since steps S314-S316 are identical to steps S212-S214 of FIG. 3 described above in the first embodiment, a description of these steps will not be repeated. Note that in S315 the prescribed threshold values Th1 and Th2 are respectively changed to the modified prescribed threshold values Th1 and Th2. Thus, after performing S313, in S310 the controller 11 decreases the modified threshold values Th1 and Th2 by respective prescribed values.

Hence, when the controller 11 determines that all candidate lines have been selected as the target line in the first embodiment described above and when none of the candidate lines satisfied the border condition, the controller 11 sets the borderline to the line having the largest near-white count M2 among all candidate lines. However, when all candidate lines have been selected as the target line and none satisfied the border condition in the second embodiment, the controller 11 reduces the threshold value Th1 for the white count M1 and the threshold value Th2 for the near-white count M2 so that the border condition is more easily satisfied, and subsequently reselects a line from among the candidate lines that may satisfy the border condition.

3-2. Effects

In addition to the effects in (1) and (3)-(6) of the first embodiment described above, the second embodiment obtains the following effects.

When the personal computer 1 determines that all candidate lines have been selected as the target line and that none of the candidate lines have met the border condition, in the second embodiment the personal computer 1 reduces the threshold value Th2 for the near-white count M2. Subsequently, the personal computer 1 again identifies the target line and the neighboring line. Then using the reduced threshold value Th2 for the near-white count M2, the personal computer 1 determines whether the border condition is satisfied for any of the target lines.

Accordingly, the personal computer 1 adjusts the threshold value Th2 based on the characteristics of the image represented by the image data, such as when the image has an overall whiteness. Hence, the personal computer 1 can find a borderline that is suited to the characteristics of the image.

In the second embodiment described above, S301 is an example of the acquisition portion, S302 is an example of the identification portion, S303 is an example of the white calculation portion, S304 and S307 are examples of the border determination portion, S305 is an example of the determination portion, S306 is an example of the near-white calculation portion, and S308 is an example of the completion determination portion. In addition, S309 is an example of the modification portion, S310 is an example of the first reduction portion, S312 is an example of the data count determination portion, S315 is an example of the second reduction portion, and S316 is an example of the cancellation portion.

4. Other Embodiments

While the disclosure has been described in detail with reference to the above embodiments, it would be apparent to those skilled in the art that various changes and modifications may be made thereto.

(1) In the embodiments, when determining that the number N of sets of finalized band data is greater than the threshold value Th3, the controller 11 decreases each of the prescribed values of the threshold value Th1 for the white count M1 and the threshold value Th2 for the near-white count M2 by respective prescribed values so as to set a modified prescribed threshold value Th1 and a modified prescribed threshold value Th2. However, the content of the process performed when the personal computer 1 determines that the number N of sets of finalized band data is greater than the threshold value Th3 is not limited to the example in the embodiments. For example, the personal computer 1 may increase the threshold value Th4 used to define a near-white pixel based on the sum of the inverted lightness value and the chroma value of the pixel in addition to or in place of reducing the threshold values Th1 and Th2 by prescribed values when the controller 11 determines that the number N of sets of finalized band data is greater than the threshold value Th3. This method also makes the border condition easier to satisfy. As a result, the personal computer 1 can increase the widths of the band images and consequently can reduce the number of sets of band data representing the band images.

(2) In the embodiments, near-white pixels are defined as pixels having an inverted lightness value and a chroma value whose sum is no greater than the threshold value Th4. However, definition of the near-white pixels is not limited to this. For example, pixels may be determined to be near-white pixels when the square root of the sum of the square of the inverse of lightness and the square of the chroma is less than or equal to a prescribed threshold value. In this case, a near-white pixel still satisfies the condition that the chroma be no greater than a prescribed chroma threshold value and the condition that the lightness be at least a prescribed lightness threshold value. Hence, satisfying both the condition that the chroma is no greater than the prescribed chroma threshold value and the condition that the lightness is at least the prescribed lightness threshold value (or more generally, satisfying at least one of these two conditions) is a necessary condition for the pixel to be a near-white pixel.

(3) While the band data determination process is performed prior to the color conversion process in the embodiments described above, the order for performing the band data determination process is not limited to this order. For example, the band data determination process may be performed after the color conversion process.

(4) While the personal computer 1 executes the band data determination process in the embodiments described above, the printer 2 or another device may be used to execute this process instead.

(5) In the embodiments, the band data determination process is executed for a single-pass printing system 100, but the band data determination process may be executed for a multi-pass printing system that scans the print head 27 a plurality of times to print a plurality of consecutive lines.

(6) In the embodiments described above, all or at least functions or process executed by the controller 11 may be performed hardware having one or more ICs.

(7) A plurality of functions possessed by a single component in the embodiments may be implemented using a plurality of components instead, and a single function possessed by a single component in the embodiments may be implemented using a plurality of components. Similarly, a plurality of functions possessed by a plurality of components in the embodiments may be implemented using a single component instead, and a single function implemented by a plurality of components in the embodiments may be implemented using a single component instead. Further, some parts of the structure described in the embodiments may be omitted. Further, at least part of the structure in one of the embodiments described above may be added to or replaced with the structure of another embodiment described above. Note that all aspects included in the technical idea set forth in the language of the claims are an embodiment of the present disclosure.

What is claimed is:

1. A non-transitory computer readable storage medium storing a set of program instructions installed on and executed by a computer as an image processor for controlling a print execution machine having a print head configured to eject ink from a plurality of nozzles arranged in a subscanning direction and a conveyance machine configured to convey a recording sheet, wherein the print execution machine is configured to print an image on the recording sheet by scanning the print head a plurality of times in a main scanning direction perpendicular to the subscanning direction, the set of program instructions comprising:

extracting, from image data representing an original image, provisional band data representing a provisional band image, the provisional band image being capable of being printed by one scanning of the print head, the provisional band image including a plurality of candidate lines, each of the plurality of candidate lines having a plurality of pixels arranged in the main scanning direction;

identifying a target line from the plurality of candidate lines and a neighboring line neighboring the target line in the original image;

calculating near white number for the target line, the near white number for the target line being number of pairs of a first pixel and a second pixel, wherein the first pixel is located on the target line, the second pixel is located on the neighboring line and in positionally adjacent relation to the first pixel, and at least one of the first pixel and the second pixel is a near white pixel, wherein the near white pixel is defined as a pixel satisfying at least one of a condition that a chroma value of the pixel is smaller than or equal to a chroma threshold value and a condition that a lightness value of the pixel is greater than or equal to a lightness threshold value;

determining whether a prescribed boarder condition for the target line is met, wherein the prescribed border condition for the target line indicates that the near white number for the target line is greater than or equal to a first threshold value;

in a case where the prescribed border condition is met for the target line, determining finalized band data representing a finalized band image, the finalized band image including at least part of the provisional band image, the finalized band image having the target line as a borderline, the borderline being closest to a border of the finalized band image, the finalized band image being capable of being printed by one scanning of the print head;

outputting image data including band data based on the finalized band data to the print execution machine; and in a case where a specific condition is met, changing the target line to one of the plurality of candidate lines which is not selected as the target line, the specific condition including a condition that the prescribed border condition is not met for the current target line.

2. The non-transitory computer readable storage medium according to claim 1, wherein the set of program instructions further comprises determining whether all of the plurality of candidate lines are selected as the target line in a case where the prescribed border condition is not met for the target line, wherein the specific condition further includes a condition that at least one of the plurality of candidate lines is not selected as the target line, wherein in a case where all of the plurality of candidate lines are selected as the target line, the target line is changed to a candidate line having a maximum near white number from among the plurality of candidate lines which is selected as the target line, wherein in a case where all of the plurality of candidate lines are selected as the target line, the finalized band data is determined so that the finalized band image includes at least part of the provisional band image, the finalized band image has the changed target line as the borderline, and the finalized band image is capable of being printed by one scanning of the print head.

3. The non-transitory computer readable storage medium according to claim 1, wherein the set of program instructions further comprises:

determining whether all of the plurality of candidate lines are selected as the target line in a case where the prescribed border condition is not met for the target line; and decreasing the first threshold value in a case where all of the plurality of candidate lines are selected as the target line, wherein in the case where all of the plurality of candidate lines are selected as the target line, a target line is again identified from the plurality of candidate lines, wherein in the case where all of the plurality of candidate lines are selected as the target line, a neighboring line neighboring the target line is again identified in the original image, wherein it is determined whether the prescribed boarder condition for the target line is met by using the decreased first threshold.

4. The non-transitory computer readable storage medium according to claim 1, wherein the set of program instructions further comprises calculating white number for the target line, the white number for the target line being number of pairs of a third pixel and a fourth pixel, wherein the third pixel is located on the target line, the fourth pixel is located on the neighboring line and in positionally adjacent relation to the third pixel, and at least one of the third pixel and the fourth pixel is a white pixel, wherein it is determined that the prescribed boarder condition is met in a case where the white number for the target line is greater than or equal to a second threshold value.

5. The non-transitory computer readable storage medium according to claim 1, wherein the set of program instructions further comprises:

after a plurality of sets of finalized band data constituting the image data is determined, determining whether number of the plurality of sets of finalized band data is smaller than or equal to a third threshold value;

decreasing the first threshold value in a case where the number of the plurality of sets of finalized band data is greater than the third threshold value; and cancelling determinations of the plurality of sets of finalized band data in the case where the number of the plurality of sets of finalized band data is greater than the third threshold value, wherein a target line is again determined from the plurality of candidate lines in the case where the number of the plurality of sets of finalized band data is greater than the third threshold value, wherein a neighboring line neighboring the target line is again determined in the original image in the case where the number of the plurality of sets of finalized band data is greater than the third threshold value.

6. The non-transitory computer readable storage medium according to claim 1, wherein a borderline of the provisional band image is identified as the target line, wherein a line that neighbors the target line is identified as neighboring line, wherein the neighboring line is located opposite to a side in the provisional band image, wherein the side leads away from the borderline of the provisional band image, wherein the target line is changed to a changed target line, wherein the changed target line is a line that neighbors the current target line and is located at opposite to the side in the provisional band image.

7. The non-transitory computer readable storage medium according to claim 1, wherein the near white pixel is a pixel having an inverted lightness value and a chroma value whose sum is smaller than or equal to a fourth threshold value, the inverted lightness value being a value obtained by reversing plus/minus sign of a lightness value of the pixel.

8. The non-transitory computer readable storage medium according to claim 1, wherein a length of the provisional band image in a conveyance direction of the recording sheet is longer than a length of the print head in the conveyance direction.

9. An image processing apparatus comprising:

a print execution machine having a print head configured to eject ink from a plurality of nozzles arranged in a subscanning direction and a conveyance machine configured to convey a recording sheet, wherein the print execution machine is configured to print an image on the recording sheet by scanning the print head a plurality of times in a main scanning direction perpendicular to the subscanning direction;

a processor comprising hardware; and a memory storing computer-readable instructions therein, the computer-readable instructions, when executed by the processor, causing the image processing apparatus to perform:

extracting, from image data representing an original image, provisional band data representing a provisional band image, the provisional band image being capable of being printed by one scanning of the print head, the provisional band image including a plurality of candidate lines, each of the plurality of candidate lines having a plurality of pixels arranged in the main scanning direction;

identifying a target line from the plurality of candidate lines and a neighboring line neighboring the target line in the original image;

calculating near white number for the target line, the near white number for the target line being number of pairs of a first pixel and a second pixel, wherein the first pixel is located on the target line, the second pixel is located on the neighboring line and in positionally adjacent relation to the first pixel, and at least one of the first pixel and the second pixel is a near white pixel, wherein the near white pixel is defined as a pixel satisfying at least one of a condition that a chroma value of the pixel is smaller than or equal to a chroma threshold value and a condition that a lightness value of the pixel is greater than or equal to a lightness threshold value;

determining whether a prescribed boarder condition for the target line is met, wherein the prescribed border condition for the target line indicates that the near white number for the target line is greater than or equal to a first threshold value;

in a case where the prescribed border condition is met for the target line, determining finalized band data representing a finalized band image, the finalized band image including at least part of the provisional band image, the finalized band image having the target line as a borderline, the borderline being closest to a border of the finalized band image, the finalized band image being capable of being printed by one scanning of the print head;

outputting image data including band data based on the finalized band data to the print execution machine; and in a case where a specific condition is met, changing the target line to one of the plurality of candidate lines which is not selected as the target line, the specific condition including a condition that the prescribed border condition is not met for the current target line.

10. The image processing apparatus according to claim 9, wherein the computer-readable instructions, when executed by the processor, causes the image processing apparatus to perform determining whether all of the plurality of candidate lines are selected as the target line in a case where the prescribed border condition is not met for the target line, wherein the specific condition further includes a condition that at least one of the plurality of candidate lines is not selected as the target line, wherein in a case where all of the plurality of candidate lines are selected as the target line, the target line is changed to a candidate line having a maximum near white number from among the plurality of candidate lines which is selected as the target line, wherein in a case where all of the plurality of candidate lines are selected as the target line, the finalized band data is determined so that the finalized band image includes at least part of the provisional band image, the finalized band image has the changed target line as the borderline, and the finalized band image is capable of being printed by one scanning of the print head.

11. The image processing apparatus to claim 9, wherein the computer-readable instructions, when executed by the processor, causes the image processing apparatus to perform:

determining whether all of the plurality of candidate lines are selected as the target line in a case where the prescribed border condition is not met for the target line; and decreasing the first threshold value in a case where all of the plurality of candidate lines are selected as the target line, wherein in the case where all of the plurality of candidate lines are selected as the target line, a target line is again identified from the plurality of candidate lines, wherein in the case where all of the plurality of candidate lines are selected as the target line, a neighboring line neighboring the target line is again identified in the original image, wherein it is determined whether the prescribed boarder condition for the target line is met by using the decreased first threshold.

12. The image processing apparatus according to claim 9, wherein the computer-readable instructions, when executed by the processor, causes the image processing apparatus to perform calculating white number for the target line, the white number for the target line being number of pairs of a third pixel and a fourth pixel, wherein the third pixel is located on the target line, the fourth pixel is located on the neighboring line and in positionally adjacent relation to the third pixel, and at least one of the third pixel and the fourth pixel is a white pixel, wherein it is determined that the prescribed boarder condition is met in a case where the white number for the target line is greater than or equal to a second threshold value.

13. The image processing apparatus according to claim 9, wherein the computer-readable instructions, when executed by the processor, causes the image processing apparatus to perform:

after a plurality of sets of finalized band data constituting the image data is determined, determining whether number of the plurality of sets of finalized band data is smaller than or equal to a third threshold value;

decreasing the first threshold value in a case where the number of the plurality of sets of finalized band data is greater than the third threshold value; and cancelling determinations of the plurality of sets of finalized band data in the case where the number of the plurality of sets of finalized band data is greater than the third threshold value, wherein a target line is again determined from the plurality of candidate lines in the case where the number of the plurality of sets of finalized band data is greater than the third threshold value, wherein a neighboring line neighboring the target line is again determined in the original image in the case where the number of the plurality of sets of finalized band data is greater than the third threshold value.

14. The image processing apparatus according to claim 9, wherein a borderline of the provisional band image is identified as the target line, wherein a line that neighbors the target line is identified as neighboring line, wherein the neighboring line is located opposite to a side in the provisional band image, wherein the side leads away from the borderline of the provisional band image, wherein the target line is changed to a changed target line, wherein the changed target image is a line that neighbors the current target line and is located at opposite to the side in the provisional band image.

15. The image processing apparatus according to claim 9, wherein the near white pixel is a pixel having an inverted lightness value and a chroma value whose sum is smaller than or equal to a fourth threshold value, the inverted lightness value being a value obtained by reversing plus/minus sign of a lightness value of the pixel.

16. The image processing apparatus according to claim 9, wherein a length of the provisional band image in a conveyance direction of the recording sheet is longer than a length of the print head in the conveyance direction.

17. A method for controlling a print execution machine having a print head configured to eject ink from a plurality of nozzles arranged in a subscanning direction and a conveyance machine configured to convey a recording sheet, wherein the print execution machine is configured to print an image on the recording sheet by scanning the print head a plurality of times in a main scanning direction perpendicular to the subscanning direction, the method comprising:

extracting, from image data representing an original image, provisional band data representing a provisional band image, the provisional band image being capable of being printed by one scanning of the print head, the provisional band image including a plurality of candidate lines, each of the plurality of candidate lines having a plurality of pixels arranged in the main scanning direction;

identifying a target line from the plurality of candidate lines and a neighboring line neighboring the target line in the original image;

calculating near white number for the target line, the near white number for the target line being number of pairs of a first pixel and a second pixel, wherein the first pixel is located on the target line, the second pixel is located on the neighboring line and in positionally adjacent relation to the first pixel, and at least one of the first pixel and the second pixel is a near white pixel, wherein the near white pixel is defined as a pixel satisfying at least one of a condition that a chroma value of the pixel is smaller than or equal to a chroma threshold value and a condition that a lightness value of the pixel is greater than or equal to a lightness threshold value;

determining whether a prescribed boarder condition for the target line is met, wherein the prescribed border condition for the target line indicates that the near white number for the target line is greater than or equal to a first threshold value;

in a case where the prescribed border condition is met for the target line, determining finalized band data representing a finalized band image, the finalized band image including at least part of the provisional band image, the finalized band image having the target line as a borderline, the borderline being closest to a border of the finalized band image, the finalized band image being capable of being printed by one scanning of the print head;

outputting image data including band data based on the finalized band data to the print execution machine; and in a case where a specific condition is met, changing the target line to one of the plurality of candidate lines which is not selected as the target line, the specific condition including a condition that the prescribed border condition is not met for the current target line.

18. The method according to claim 17, further comprising determining whether all of the plurality of candidate lines are selected as the target line in a case where the prescribed border condition is not met for the target line, wherein the specific condition further includes a condition that at least one of the plurality of candidate lines is not selected as the target line, wherein in a case where all of the plurality of candidate lines are selected as the target line, the target line is changed to a candidate line having a maximum near white number from among the plurality of candidate lines which is selected as the target line in, wherein in a case where all of the plurality of candidate lines are selected as the target line, the finalized band data is determined so that the finalized band image includes at least part of the provisional band image, the finalized band image has the changed target line as the borderline, and the finalized band image is capable of being printed by one scanning of the print head.

19. The method according to claim 17, further comprising:

determining whether all of the plurality of candidate lines are selected as the target line in a case where the prescribed border condition is not met for the target line; and decreasing the first threshold value in a case where all of the plurality of candidate lines are selected as the target line, wherein in the case where all of the plurality of candidate lines are selected as the target line, a target line is again identified from the plurality of candidate lines, wherein in the case where all of the plurality of candidate lines are selected as the target line, a neighboring line neighboring the target line is again identified in the original image, wherein it is determined whether the prescribed boarder condition for the target line is met by using the decreased first threshold.

20. The method according to claim 17, further comprising calculating white number for the target line, the white number for the target line being number of pairs of a third pixel and a fourth pixel, wherein the third pixel is located on the target line, the fourth pixel is located on the neighboring line and in positionally adjacent relation to the third pixel, and at least one of the third pixel and the fourth pixel is a white pixel, wherein it is determined that the prescribed boarder condition is met in a case where the white number for the target line is greater than or equal to a second threshold value.

* * * * *